US010932075B2

(12) United States Patent
Tammi et al.

(10) Patent No.: US 10,932,075 B2
(45) Date of Patent: Feb. 23, 2021

(54) SPATIAL AUDIO PROCESSING APPARATUS

(71) Applicant: Nokia Technologies Oy, Espoo (FI)

(72) Inventors: Mikko Tammi, Tampere (FI); Miikka Vilermo, Tampere (FI); Kemal Ugur, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/167,666

(22) Filed: Oct. 23, 2018

(65) Prior Publication Data

US 2019/0069111 A1 Feb. 28, 2019

Related U.S. Application Data

(63) Continuation of application No. 14/367,912, filed as application No. PCT/IB2011/055911 on Dec. 22, 2011, now Pat. No. 10,154,361.

(51) Int. Cl.

| | |
|---|---|
| ***H04S 7/00*** | (2006.01) |
| ***H04R 3/00*** | (2006.01) |
| ***H04R 29/00*** | (2006.01) |

(52) U.S. Cl.

CPC ..... *H04S 7/30* (2013.01); *H04R 3/005* (2013.01); *H04R 29/005* (2013.01); *H04R 2201/401* (2013.01); *H04R 2430/23* (2013.01)

(58) Field of Classification Search

CPC ..... H04S 7/30; H04S 7/303; H04S 2400/11; H04R 3/005; H04R 29/005; H04R 2201/401; H04R 2430/20; H04R 2430/23

See application file for complete search history.

(56) References Cited

U.S. PATENT DOCUMENTS

| | | | | |
|---|---|---|---|---|
| 5,781,184 | A | 7/1998 | Wasserman | |
| 6,559,863 | B1 | 5/2003 | Megiddo | |
| 8,184,069 | B1 | 5/2012 | Rhodes | |
| 8,190,438 | B1 | 5/2012 | Nelissen | |
| 9,313,599 | B2 * | 4/2016 | Tammi | H04R 5/02 |
| 2003/0007648 | A1 | 1/2003 | Currell | |
| 2004/0002843 | A1 | 1/2004 | Robarts et al. | |
| 2004/0013278 | A1 | 1/2004 | Yamada | |
| 2005/0117753 | A1 | 6/2005 | Miura | |

(Continued)

FOREIGN PATENT DOCUMENTS

| | | | |
|---|---|---|---|
| WO | WO-2011/076286 | A1 | 6/2011 |
| WO | WO-2012/072798 | A1 | 6/2012 |
| WO | WO-2012/072804 | A1 | 6/2012 |

OTHER PUBLICATIONS

Del Galdo et al., "Interactive Teleconferencing Combining Spatial Audio Object Coding and DirAC Technology" AES Convention 128, May 22-25, 2010.

(Continued)

*Primary Examiner* — Yogeshkumar Patel
(74) *Attorney, Agent, or Firm* — Alston & Bird LLP

(57) ABSTRACT

An apparatus comprising: a directional analyser configured to determine a directional component of at least two audio signals; an estimator configured to determine at least one virtual position or direction relative to the actual position of the apparatus; and a signal generator configured to generate at least one further audio signal dependent on the at least one virtual position or direction relative to the actual position of the apparatus and the directional component of at least two audio signals.

20 Claims, 14 Drawing Sheets

(56) References Cited

U.S. PATENT DOCUMENTS

2005/0190935 A1 9/2005 Sakamoto
2005/0220308 A1 10/2005 Sekine et al.
2005/0281410 A1* 12/2005 Grosvenor ..... H04H 60/04 381/61
2006/0008117 A1* 1/2006 Kanada ..... H04S 7/302 382/103
2006/0050890 A1 3/2006 Tsuhako
2006/0262935 A1 11/2006 Goose et al.
2007/0168359 A1 7/2007 Jacob et al.
2007/0192910 A1 8/2007 Vu et al.
2007/0223717 A1 9/2007 Boersma
2008/0243278 A1 10/2008 Dalton et al.
2008/0297571 A1 12/2008 Umeda
2008/0297586 A1 12/2008 Kurtz et al.
2008/0297587 A1 12/2008 Kurtz et al.
2008/0297588 A1 12/2008 Kurtz et al.
2008/0297589 A1 12/2008 Kurtz et al.
2009/0080632 A1* 3/2009 Zhang ..... H04M 3/56 379/202.01
2009/0092259 A1 4/2009 Jot et al.
2009/0116652 A1* 5/2009 Kirkeby ..... H04S 7/303 381/1
2009/0225026 A1* 9/2009 Sheba ..... G06F 1/1626 345/156
2009/0252356 A1 10/2009 Goodwin et al.
2009/0252379 A1 10/2009 Kondo et al.
2010/0014693 A1 1/2010 Park et al.
2010/0069115 A1* 3/2010 Liu ..... H04M 1/72569 455/556.1
2010/0098274 A1 4/2010 Hannemann et al.
2010/0128892 A1* 5/2010 Chen ..... H04R 3/005 381/92
2010/0208065 A1 8/2010 Heiner et al.
2010/0328423 A1 12/2010 Etter
2011/0063461 A1 3/2011 Masuda
2011/0081024 A1* 4/2011 Soulodre ..... G01S 3/8006 381/17
2011/0115987 A1 5/2011 Kubo
2011/0178798 A1 7/2011 Flaks et al.
2011/0206217 A1 8/2011 Weis
2011/0280424 A1 11/2011 Takagi et al.
2012/0039477 A1 2/2012 Schijers et al.
2012/0071997 A1 3/2012 Aliakseyeu et al.
2012/0076304 A1 3/2012 Suzuki
2012/0076305 A1 3/2012 Virolainen
2012/0076316 A1 3/2012 Zhu et al.
2012/0127264 A1 5/2012 Jung et al.
2012/0128175 A1* 5/2012 Visser ..... H04R 3/005 381/92
2012/0162470 A1 6/2012 Kim et al.
2012/0163606 A1 6/2012 Eronen et al.
2012/0163625 A1* 6/2012 Siotis ..... H04R 3/005 381/92
2012/0314872 A1 12/2012 Tan et al.
2012/0328109 A1 12/2012 Harma et al.
2013/0022221 A1* 1/2013 Kallai ..... H04R 3/12 381/300
2013/0083942 A1 4/2013 Aahgren et al.
2013/0142341 A1 6/2013 Del Galdo
2013/0321568 A1 12/2013 Suzuki et al.

OTHER PUBLICATIONS

Del Galdo et al., "Generating Virtual Microphone Signals Using Geometrical Information Gathered by Distributed arrays. Hands-free Speech Communication and Microphone Arrays." 2011, IEEE.
V. Pulkki et al., "Directional Audio Coding—Perception—Based Reproduction of Spatial Sound." International Workshop of the Principles and Applications of Spatial Hearing. Nov. 11-13, 2009, Japan.
U.S. Appl. No. 14/367,912, filed Feb. 3, 2015, US-2015/0139426, Allowed.
International Searching Authority, Written Opinion for Application No. PCT/IB2011/055911, dated Sep. 17, 2012, 10 pages, Swedish Patent and Registration Office, Sweden.

* cited by examiner

SPATIAL AUDIO PROCESSING APPARATUS

CROSS-REFERENCE TO RELATED APPLICATIONS

This application is a continuation of U.S. application Ser. No. 14/367,912, filed Feb. 3, 2015, which is a national phase entry of International Application No. PCT/162011/055911, filed Dec. 22, 2011, all of which are incorporated herein by reference in their entirety.

FIELD

The present application relates to apparatus for spatial audio processing. The application further relates to, but is not limited to, portable or mobile apparatus for spatial audio processing.

BACKGROUND

Audio and audio-video recording on electronic apparatus is now common. Devices ranging from professional video capture equipment, consumer grade camcorders and digital cameras to mobile phones and even simple devices as webcams can be used for electronic acquisition of motion video images. Recording video and the audio associated with video has become a standard feature on many mobile devices and the technical quality of such equipment has rapidly improved. Recording personal experiences using a mobile device is quickly becoming an increasingly important use for mobile devices such as mobile phones and other user equipment. Combining this with the emergence of social media and new ways to efficiently share content underlies the importance of these developments and the new opportunities offered for the electronic device industry.

In such devices, multiple microphones can be used to capture efficiently audio events. However it is difficult to convert the captured signals into a form such that the listener can experience the events as originally recorded. For example it is difficult to reproduce the audio event in a compact coded form as a spatial representation. Therefore often it is not possible to fully sense the directions of the sound sources or the ambience around the listener in a manner similar to the sound environment as recorded.

Multichannel playback systems such as commonly used 5.1 channel reproduction can be used for presenting spatial signals with sound sources in different directions. In other words they can be used to represent the spatial events captured with a multi-microphone system. These multi-microphone or spatial audio capture systems can convert multi-microphone generated audio signals to multi-channel spatial signals.

Similarly spatial sound can be represented with binaural signals. In the reproduction of binaural signals, headphones or headsets are used to output the binaural signals to produce a spatially real audio environment for the listener.

SUMMARY OF THE APPLICATION

Aspects of this application thus provide a spatial audio processing capability to enable more flexible audio processing.

There is provided an apparatus comprising at least one processor and at least one memory including computer code for one or more programs, the at least one memory and the computer code configured to with the at least one processor cause the apparatus to at least perform: determining a directional component of at least two audio signals; determining at least one virtual position or direction relative to the actual position of the apparatus; and generating at least one further audio signal dependent on the at least one virtual position or direction relative to the actual position of the apparatus and the directional component of at least two audio signals.

Determining a directional component of at least two audio signals may cause the apparatus to perform determining a directional analysis on the at least two audio signals.

Determining a directional analysis on the at least two audio signals may cause the apparatus to perform: dividing the at least two audio signals into frequency bands; and performing a directional analysis on the at least two audio signals frequency bands.

Determining a directional analysis may cause the apparatus to perform: determining at least one audio source with an associated directional parameter dependent on the at least two audio signals; determining an audio source audio signal associated with the at least one audio source; and determining a background audio signal associated with the at least one audio source.

Generating at least one further audio signal may cause the apparatus to perform determining for at least one audio source a virtual position directional parameter.

Generating at least one further audio signal may cause the apparatus to perform: generating a multichannel audio signal from audio sources dependent on the virtual position directional parameter; the audio source audio signal; and background audio signal for each audio source.

Generating at least one further audio signal may cause the apparatus to perform: generating a spatial filter; and applying the spatial filter to at least one audio source audio signal dependent on the associated directional parameter and the spatial filter range.

Generating the spatial filter may cause the apparatus to perform at least one of: determining a spatial filter dependent on a user input determining at least one sound source determined from the at least two audio signals; determining a spatial filter dependent on an image position generated from at least one recorded image; and determining a spatial filter dependent on a recognized image part position generated from at least one recorded image.

Determining at least one virtual position relative to the actual position of the apparatus may cause the apparatus to perform: displaying a visual representation mapping the actual position on a display; and receiving a user input from the display of the visual representation a virtual position.

The apparatus may be further caused to generate a first of at least two audio signals from a first microphone located at a first position on the apparatus and a second of the at least two audio signals from a second microphone located at a second position on the apparatus.

The apparatus may be further caused to perform obtaining the at least two audio signals are from an acoustic signal generated from at least one sound source.

The apparatus may be further caused to perform: displaying the directional component of the at least two audio signals on a display; modifying the at least two audio signals from the acoustic signal generated from the at least one sound source displayed on the display based on the virtual position or direction relative to position of the apparatus.

Modifying the at least two audio signals from the acoustic signal generated from the at least one sound source causes the apparatus to perform at least one of: amplifying at least one of the at least two audio signals; and dampening at least one of the at least two audio signals.

According to a second aspect there is provided a method comprising: determining a directional component of at least two audio signals; determining at least one virtual position or direction relative to the actual position of the apparatus; and generating at least one further audio signal dependent on the at least one virtual position or direction relative to the actual position of the apparatus and the directional component of at least two audio signals.

Determining a directional component of at least two audio signals may comprise determining a directional analysis on the at least two audio signals.

Determining a directional analysis on the at least two audio signals may comprise: dividing the at least two audio signals into frequency bands; and performing a directional analysis on the at least two audio signals frequency bands.

Determining a directional analysis may comprise: determining at least one audio source with an associated directional parameter dependent on the at least two audio signals; determining an audio source audio signal associated with the at least one audio source; and determining a background audio signal associated with the at least one audio source.

Generating at least one further audio signal may comprise determining for at least one audio source a virtual position directional parameter.

Generating at least one further audio signal may comprise: generating a multichannel audio signal from audio sources dependent on the virtual position directional parameter; the audio source audio signal; and background audio signal for each audio source.

Generating at least one further audio signal may comprise: generating a spatial filter; and applying the spatial filter to at least one audio source audio signal dependent on the associated directional parameter and the spatial filter range.

Generating the spatial filter may comprise at least one of: determining a spatial filter dependent on a user input determining at least one sound source determined from the at least two audio signals; determining a spatial filter dependent on an image position generated from at least one recorded image; and determining a spatial filter dependent on a recognized image part position generated from at least one recorded image.

Determining at least one virtual position relative to the actual position of the apparatus may comprise: capturing with at least one camera a visual representation of the view from the actual position; displaying the visual representation on a display; and receiving a user input from the display of the visual representation of the view from the actual position indicating a virtual position.

Determining at least one virtual position relative to the actual position of the apparatus may comprise: displaying a visual representation mapping the actual position on a display; and receiving a user input from the display of the visual representation a virtual position.

The method may further comprise generating a first of at least two audio signals from a first microphone located at a first position on the apparatus and a second of the at least two audio signals from a second microphone located at a second position on the apparatus.

The method may further comprise obtaining the at least two audio signals are from an acoustic signal generated from at least one sound source.

The method may further comprise: displaying the directional component of the at least two audio signals on a display; modifying the at least two audio signals from the acoustic signal generated from the at least one sound source displayed on the display based on the virtual position or direction relative to position of the apparatus.

Modifying the at least two audio signals from the acoustic signal generated from the at least one sound source may comprise at least one of: amplifying at least one of the at least two audio signals; and dampening at least one of the at least two audio signals.

According to a third aspect there is provided an apparatus comprising: a directional analyser configured to determine a directional component of at least two audio signals; an estimator configured to determine at least one virtual position or direction relative to the actual position of the apparatus; and a signal generator configured to generate at least one further audio signal dependent on the at least one virtual position or direction relative to the actual position of the apparatus and the directional component of at least two audio signals.

The directional analyser may be configured to determine a directional analysis on the at least two audio signals.

The directional analyser may comprise: a sub-band filter configured to divide the at least two audio signals into frequency bands; and a band directional analyser configured to perform a directional analysis on the at least two audio signals frequency bands.

The directional analyser may comprise: an audio source determiner configures to determine at least one audio source with an associated directional parameter dependent on the at least two audio signals; an audio source signal determiner configured to determine an audio source audio signal associated with the at least one audio source; and a background signal determiner configured to determine a background audio signal associated with the at least one audio source.

The signal generator may be configured to determine for at least one audio source a virtual position directional parameter.

The signal generator may comprise a multichannel generator configured to generate: a multichannel audio signal from audio sources dependent on the virtual position directional parameter; the audio source audio signal; and background audio signal for each audio source.

The signal generator may comprise: a spatial filter generator configured to generate a spatial filter parameter; and a spatial filter configured to applying the spatial filter parameter to at least one audio source audio signal dependent on the associated directional parameter and the spatial filter range.

The spatial filter generator may comprise at least one of: a user input spatial filter generator configured to determine the spatial filter dependent on a user input determining at least one sound source determined from the at least two audio signals; an image spatial filter generator configured to determine a spatial filter dependent on an image position generated from at least one recorded image; and a recognized image spatial filter generator configured to determine a spatial filter dependent on a recognized image part position generated from at least one recorded image.

The estimator may comprise: at least one camera configured to capture a visual representation of the view from the actual position; a display configured to displaying the visual representation; and a user interface input configured to receive a user input from the display of the visual representation of the view from the actual position indicating a virtual position.

The estimator may comprise: user interface output configured to display a visual representation mapping the actual position on a display; and a user interface input configure to receive a user input from the display of the visual representation a virtual position.

The apparatus may further comprise at least two microphones configured to generate a first of at least two audio signals from a first microphone located at a first position on the apparatus and a second of the at least two audio signals from a second microphone located at a second position on the apparatus.

The apparatus may further comprise at least two microphones configured to obtaining the at least two audio signals are from an acoustic signal generated from at least one sound source.

The apparatus may further comprise: display configured to display the directional component of the at least two audio signals on a display; the signal generator configured to modify the at least two audio signals from the acoustic signal generated from the at least one sound source displayed on the display based on the virtual position or direction relative to position of the apparatus.

The signal generator may comprise at least one spatial filter configured to: amplify at least one of the at least two audio signals; and dampen at least one of the at least two audio signals.

According to a fourth aspect there is provided an apparatus comprising: means for determining a directional component of at least two audio signals;

means for determining at least one virtual position or direction relative to the actual position of the apparatus; and means for generating at least one further audio signal dependent on the at least one virtual position or direction relative to the actual position of the apparatus and the directional component of at least two audio signals.

The means for determining a directional component of at least two audio signals may comprise means for determining a directional analysis on the at least two audio signals.

The means for determining a directional analysis on the at least two audio signals may comprise: means for dividing the at least two audio signals into frequency bands; and means for performing a directional analysis on the at least two audio signals frequency bands.

The means for determining a directional analysis may comprise: means for determining at least one audio source with an associated directional parameter dependent on the at least two audio signals; means for determining an audio source audio signal associated with the at least one audio source; and means for determining a background audio signal associated with the at least one audio source.

The means for generating at least one further audio signal may comprise means for determining for at least one audio source a virtual position directional parameter.

The means for generating at least one further audio signal may comprise means for generating: a multichannel audio signal from audio sources dependent on the virtual position directional parameter; the audio source audio signal; and background audio signal for each audio source.

The means for generating at least one further audio signal may comprise:

means for generating at least one spatial filter parameter; and means for applying the spatial filter parameter to at least one audio source audio signal dependent on the associated directional parameter and the spatial filter range.

The means for generating the spatial filter may comprises at least one of: determining a spatial filter dependent on a user input determining at least one sound source determined from the at least two audio signals; determining a spatial filter dependent on an image position generated from at least one recorded image; and determining a spatial filter dependent on a recognized image part position generated from at least one recorded image.

The means for determining at least one virtual position relative to the actual position of the apparatus may comprise: means for capturing with at least one camera a visual representation of the view from the actual position; means for displaying the visual representation on a display; and means for receiving a user input from the display of the visual representation of the view from the actual position indicating a virtual position.

The means for determining at least one virtual position relative to the actual position of the apparatus may comprise: means for displaying a visual representation mapping the actual position on a display; and means for receiving a user input from the display of the visual representation a virtual position.

The apparatus may further comprise means for generating a first of at least two audio signals from a first microphone located at a first position on the apparatus and a second of the at least two audio signals from a second microphone located at a second position on the apparatus.

The apparatus may further comprising means for obtaining the at least two audio signals are from an acoustic signal generated from at least one sound source.

The apparatus may further comprise: means for displaying the directional component of the at least two audio signals on a display; means for modifying the at least two audio signals from the acoustic signal generated from the at least one sound source displayed on the display based on the virtual position or direction relative to position of the apparatus.

The means for modifying modifying the at least two audio signals from the acoustic signal generated from the at least one sound source may comprise: means for amplifying at least one of the at least two audio signals; and means for dampening at least one of the at least two audio signals.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For better understanding of the present application, reference will now be made by way of example to the accompanying drawings in which.

EMBODIMENTS OF THE APPLICATION

The following describes in further detail suitable apparatus and possible mechanisms for the provision of effective spatial audio processing.

The concept of the application is related to determining suitable audio signal representations from captured audio signals and then processing the representations of the audio signals according to virtual or desired motion of the listener/capture device to a virtual or desired location to enable suitable spatial audio synthesis to be generated.

Figure 1:
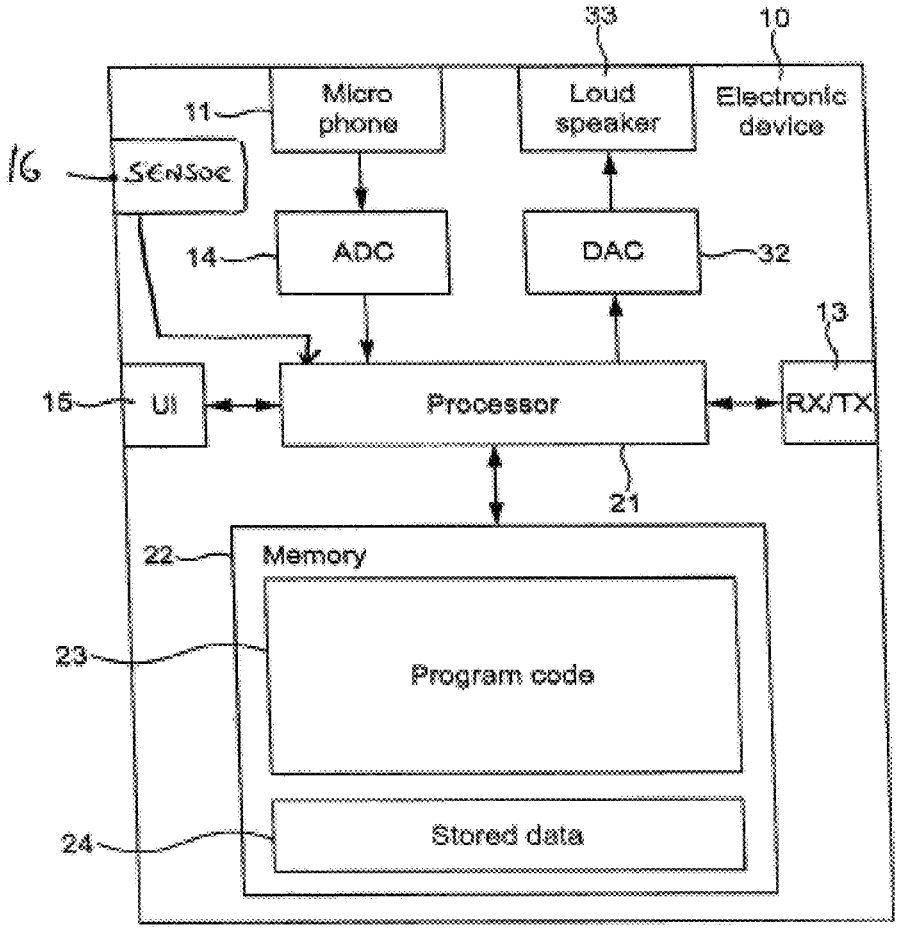
FIG. 1 shows a schematic view of an apparatus suitable for implementing embodiments.

In this regard reference is first made to FIG. 1 which shows a schematic block diagram of an exemplary apparatus or electronic device 10, which may be used to capture or monitor the audio signals, to determine audio source directions/motion and determine whether the audio source motion matches known or determined gestures for user interface purposes.

The apparatus 10 can for example be a mobile terminal or user equipment of a wireless communication system. In some embodiments the apparatus can be an audio player or audio recorder, such as an MP3 player, a media recorder/player (also known as an MP4 player), or any suitable portable device requiring user interface inputs.

In some embodiments the apparatus can be part of a personal computer system an electronic document reader, a tablet computer, or a laptop.

The apparatus 10 can in some embodiments comprise an audio subsystem. The audio subsystem for example can include in some embodiments a microphone or array of microphones 11 for audio signal capture. In some embodiments the microphone (or at least one of the array of microphones) can be a solid state microphone, in other words capable of capturing acoustic signals and outputting a suitable digital format audio signal. In some other embodiments the microphone or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphone 11 or array of microphones can in some embodiments output the generated audio signal to an analogue-to-digital converter (ADC) 14.

In some embodiments the apparatus and audio subsystem includes an analogue-to-digital converter (ADC) 14 configured to receive the analogue captured audio signal from the microphones and output the audio captured signal in a suitable digital form. The analogue-to-digital converter 14 can be any suitable analogue-to-digital conversion or processing means.

In some embodiments the apparatus 10 and audio subsystem further includes a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio subsystem can include in some embodiments a speaker 33. The speaker 33 can in some embodiments receive the output from the digital-to-analogue converter 32 and present the analogue audio signal to the user.

In some embodiments the speaker 33 can be representative of a headset, for example a set of headphones, or cordless headphones.

Although the apparatus 10 is shown having both audio capture and audio presentation components, it would be understood that in some embodiments the apparatus 10 can comprise the audio capture only such that in some embodiments of the apparatus the microphone (for audio capture) and the analogue-to-digital converter are present.

In some embodiments the apparatus 10 comprises a processor 21. The processor 21 is coupled to the audio subsystem and specifically in some examples the analogue-to-digital converter 14 for receiving digital signals representing audio signals from the microphone 11, and the digital-to-analogue converter (DAC) 12 configured to output processed digital audio signals.

The processor 21 can be configured to execute various program codes. The implemented program codes can comprise for example source determination, audio source direction estimation, and audio source motion to user interface gesture mapping code routines.

In some embodiments the apparatus further comprises a memory 22. In some embodiments the processor 21 is coupled to memory 22. The memory 22 can be any suitable storage means. In some embodiments the memory 22 comprises a program code section 23 for storing program codes implementable upon the processor 21 such as those code routines described herein. Furthermore in some embodiments the memory 22 can further comprise a stored data section 24 for storing data, for example audio data that has been captured in accordance with the application or audio data to be processed with respect to the embodiments described herein. The implemented program code stored within the program code section 23, and the data stored within the stored data section 24 can be retrieved by the processor 21 whenever needed via a memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The transceiver 13 can communicate with further devices by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the transceiver is configured to transmit and/or receive the audio signals for processing according to some embodiments as discussed herein.

In some embodiments the apparatus comprises a position sensor 16 configured to estimate the position of the apparatus 10. The position sensor 16 can in some embodiments be a satellite positioning sensor such as a GPS (Global Positioning System), GLONASS or Galileo receiver.

In some embodiments the positioning sensor can be a cellular ID system or an assisted GPS system.

In some embodiments the apparatus 10 further comprises a direction or orientation sensor. The orientation/direction sensor can in some embodiments be an electronic compass, accelerometer, a gyroscope or be determined by the motion of the apparatus using the positioning estimate.

It is to be understood again that the structure of the apparatus 10 could be supplemented and varied in many ways.

Figure 2:
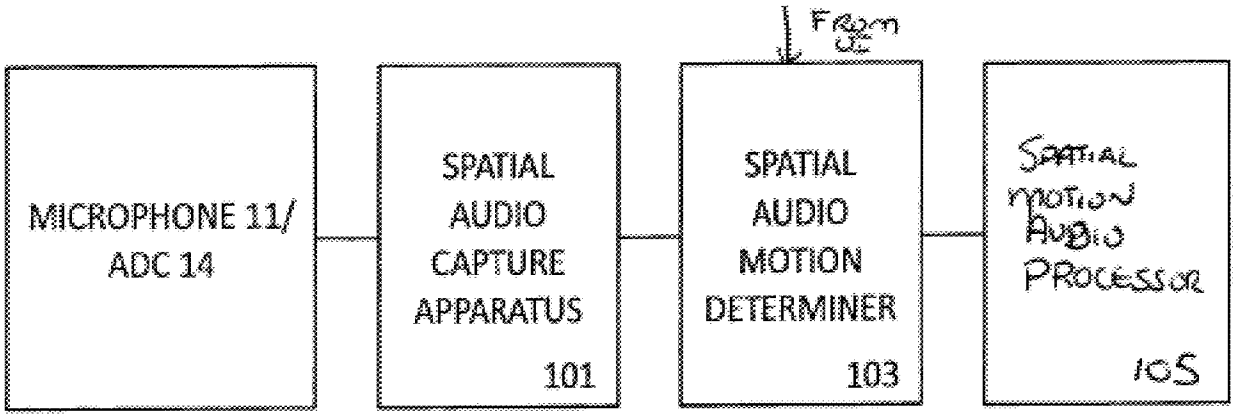
FIG. 2 shows schematically apparatus suitable for implementing embodiments in further detail.

With respect to FIG. 2 the spatial audio processor apparatus according to some embodiments is shown in further detail. Furthermore with respect to FIG. 3 the operation of such apparatus is described.

The apparatus as described herein comprise a microphone array including at least two microphones and an associated analogue-to-digital converter suitable for converting the signals from the microphone array into a suitable digital format for further processing. The microphone array can be, for example located on the apparatus at ends of the apparatus and separated by a distance d. The audio signals can therefore be considered to be captured by the microphone array and passed to a spatial audio capture apparatus 101.

Figure 8:
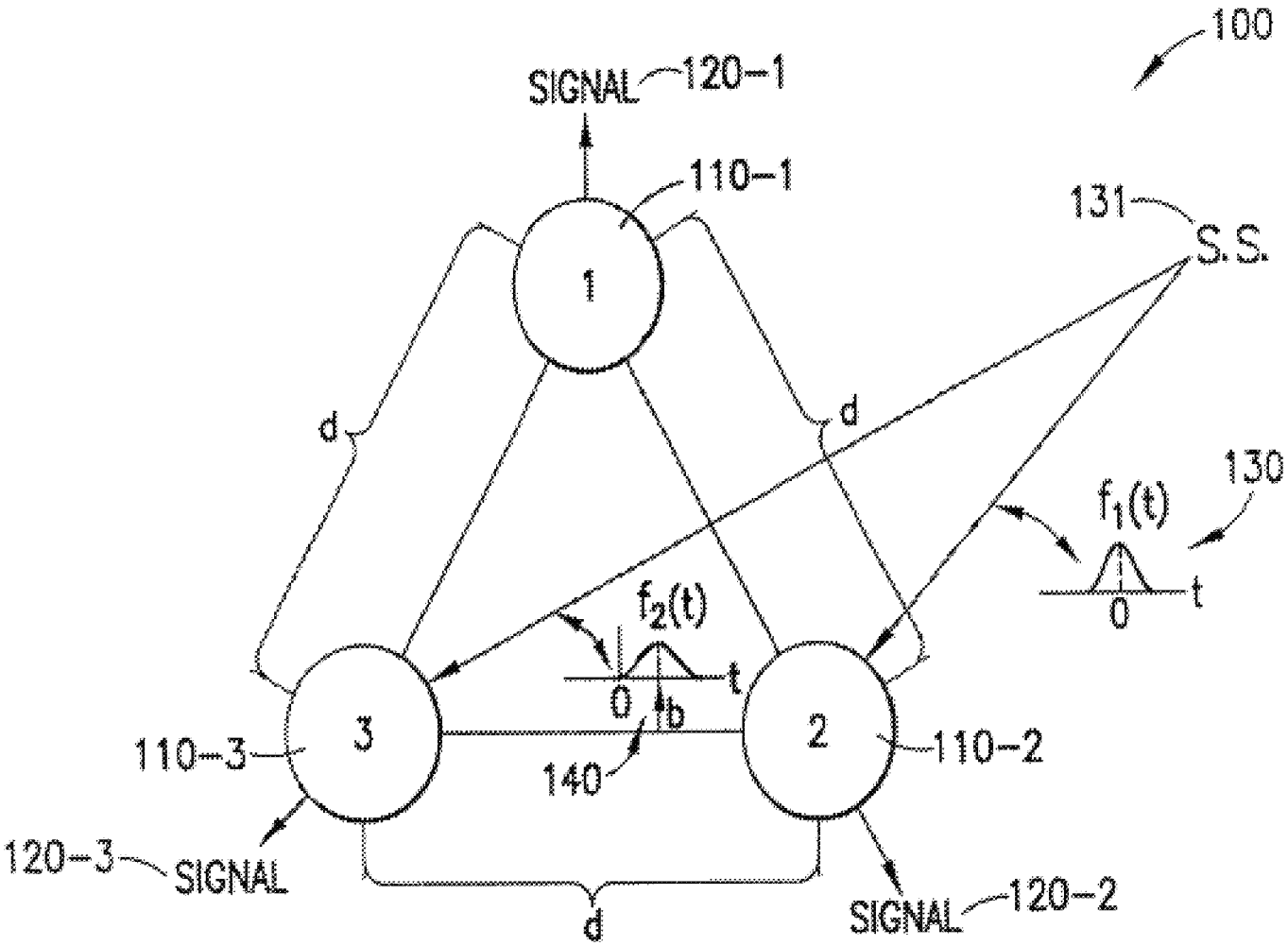
FIG. 8 shows an example microphone-arrangement according to some embodiments.

FIG. 8, for example, shows an example microphone array arrangement of a first microphone 110-1, a second microphone 110-2 and a third microphone 110-3. In this example the microphones are arranged at the vertices of an equilateral triangle. However the microphones can be arranged in any suitable shape or arrangement. In this example each microphone is separated by a dimension or distance d from each other and each pair of microphones can be considered to be orientated by an angle of 120° from the other two pairs of microphone forming the array. The separation between each microphone is such that the audio signal received from a signal source 131 can arrive at a first microphone, for example microphone 3 110-3 earlier than one of the other microphones, such as microphone 2 110-3. This can for example be seen by the time domain audio signal $f_1(t)$ 120-2 occurring at the first time instance and the same audio signal being received at the third microphone $f_2(t)$ 120-3 at a time delayed with respect to the second microphone signal by a time delay value of b.

In the following examples the processing of the audio signals with respect to a single microphone array pair is described. However it would be understood that any suitable microphone array configuration can be scaled up from pairs of microphones where the pairs define lines or planes which are offset from each other in order to monitor audio sources with respect to a single dimension, for example azimuth or elevation, two dimensions, such as azimuth and elevation and furthermore three dimensions, such as defined by azimuth, elevation and range.

There are several use cases for the embodiments described herein. Firstly when the audio is combined with video on an apparatus, a user of the playback apparatus can select using suitable user interface inputs select a person or other sound source from the video display and zoom the video picture to the source only. With the proposed embodiments solutions, the audio signals can be updated to correspond to this new desired observing location. In such embodiments the spatial audio field can be maintained to be realistic using the virtual location of the 'listener' when moved or located at a new position. In some embodiments the spatially processed audio can provide a better experience as the image direction and audio direction for the virtual or desired location 'match'.

In some embodiments where the apparatus is operating as a pure listening device there can be limits to recording downloads. For example there can be recorded audio available for some locations but none for other locations. Using such embodiments as described herein may be possible to synthesize audio in new locations utilising nearby audio recordings.

In some embodiments using a suitable user interface input, a "listener" can move virtually in the spatial audio field and thus explore more carefully different sound sources in different directions. In some embodiments some applications such as teleconferencing can use embodiments to modify the directions from which participants can be heard as the user 'virtually' moves in the conference room to attempt to make the teleconference as clear as possible. Furthermore in some embodiments the apparatus can enable damping or filtering of directions and enhancement or amplification of other directions to concentrate the audio scene with respect to defined audio sources or directions. For example unpleasant sound sources can be removed in some embodiments.

In some embodiments the user interface can apply video based user interface. For example in some embodiments the audio processing can generate representations of each audio source can furthermore be configured to modify the audio source dependent on the user touching a sound source on the video they wish to modify.

Thus embodiments describe a concept which firstly determines specific audio parameters relating to captured microphone or retrieved or received audio channel signals and further perform spatial domain audio processing to permit flexible spatial audio processing, or permit enhanced audio reproduction or synthesis applications. In some embodiments as described herein the user interface input permits the modification of sound sources and synthesised sound in a flexible manner, in particular in some embodiments the use of a camera to provide a visual interface for assisting the spatial audio processing.

Figure 3:
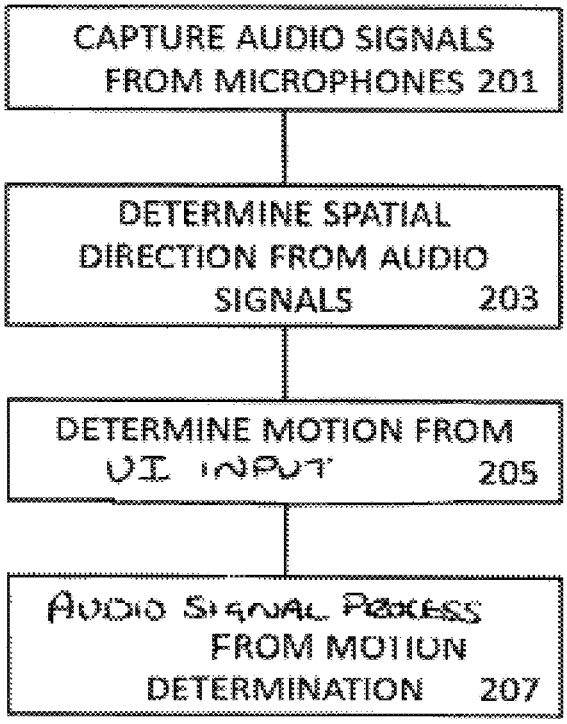
FIG. 3 shows the operation of the apparatus shown in FIG. 2 according to some embodiments.

The operation of capturing acoustic signals or generating audio signals from microphones is shown in FIG. 3 by step 201.

It would be understood that in some embodiments the capturing of audio signals is performed at the same time or in parallel with capturing of video images. Furthermore it would be understood that in some embodiments the generating of audio signals can represent the operation of receiving audio signals or retrieving audio signals from memory. Thus in some embodiments the generating of audio signals operations can include receiving audio signals via a wireless communications link or wired communications link.

In some embodiments the apparatus comprises a spatial audio capture apparatus 101. The spatial audio capture apparatus 101 is configured to, based on the inputs such as generated audio signals from the microphones or received audio signals via a communications link or from a memory, perform directional analysis to determine an estimate of the direction or location of sound sources, and furthermore in some embodiments generate an audio signal associated with the sound or audio source and of the ambient sounds. The spatial audio capture apparatus 101 then can be configured to output determined directional audio source and ambient sound parameters to a spatial audio 'motion' determiner 103.

The operation of determining audio source and ambient parameters, such as audio source spatial direction estimates from audio signals is shown in FIG. 3 by step 203.

Figure 4:
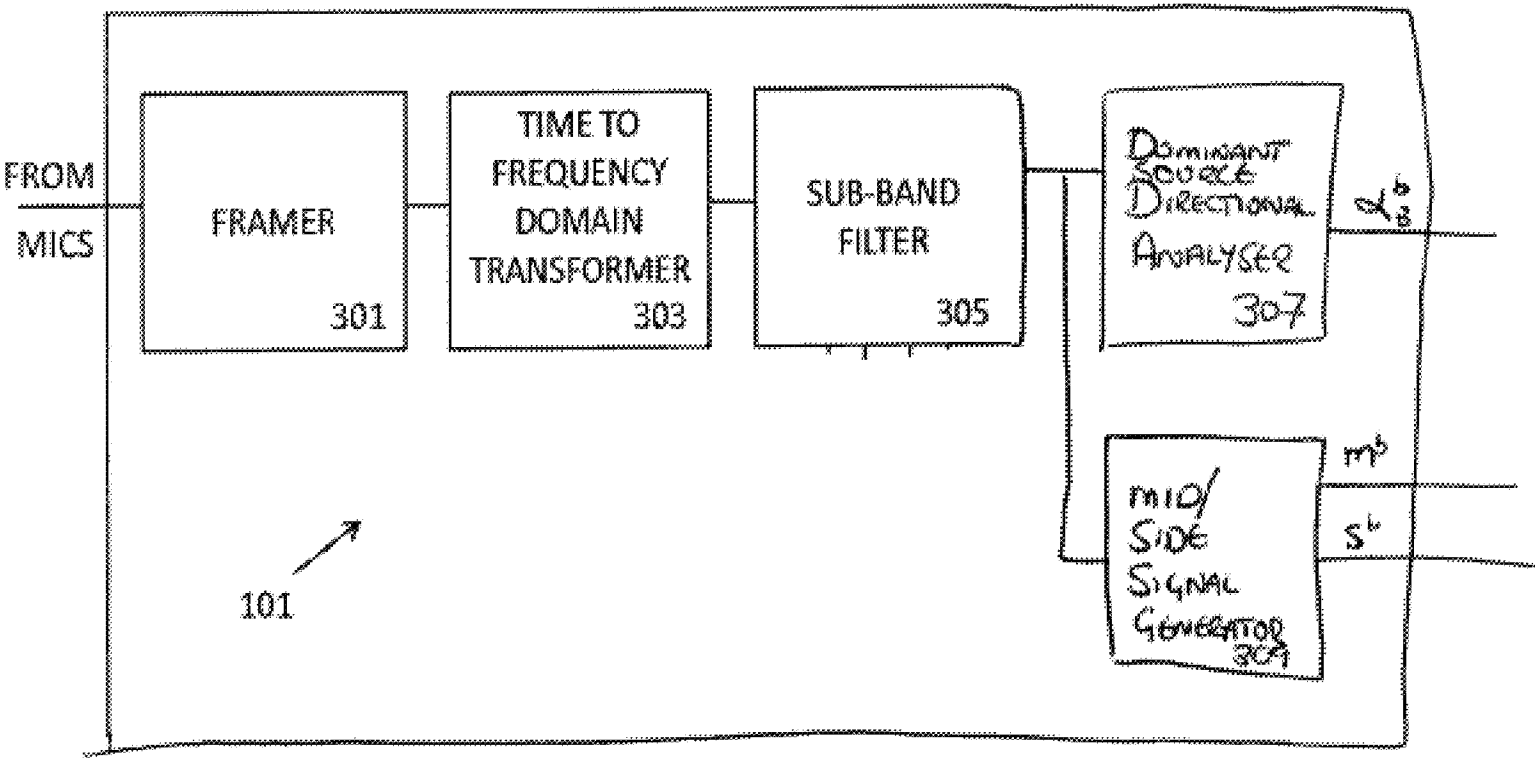
FIG. 4 shows the spatial audio capture apparatus according to some embodiments.

With respect to FIG. 4 an example spatial audio capture apparatus 101 is shown in further detail. It would be understood that any suitable method of estimating the direction of the arriving sound can be performed other than the apparatus described herein. For example the directional analysis can in some embodiments be carried out in the time domain rather than in the frequency domain as discussed herein.

Figure 5:
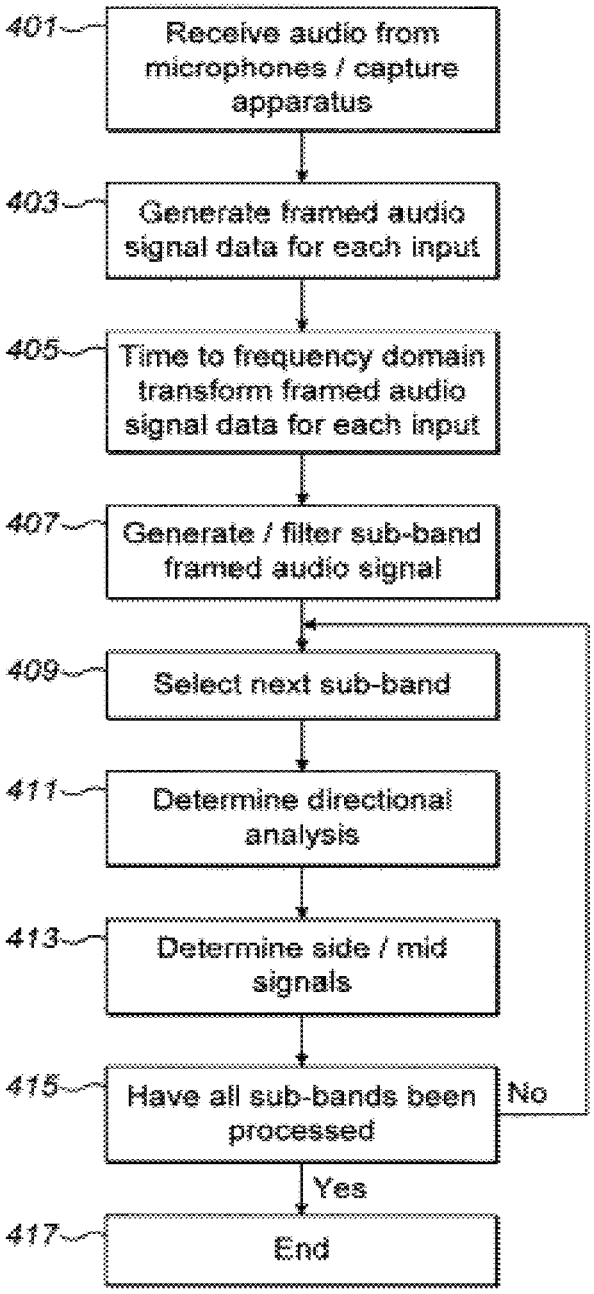
FIG. 5 shows a flow diagram of the operation of the spatial audio capture apparatus according to some embodiments.

With respect to FIG. 5, the operation of the spatial audio capture apparatus shown in FIG. 4 is described in further detail.

The apparatus can as described herein comprise a microphone array including at least two microphones and an associated analogue-to-digital converter suitable for converting the signals from the microphone array at least two microphones into a suitable digital format for further processing. The microphones can be, for example, be located on the apparatus at ends of the apparatus and separated by a distance d. The audio signals can therefore be considered to be captured by the microphone and passed to a spatial audio capture apparatus 101.

The operation of receiving audio signals is shown in FIG. 5 by step 401.

In some embodiments the apparatus comprises a spatial audio capture apparatus 101. The spatial audio capture apparatus 101 is configured to receive the audio signals from the microphones and perform spatial analysis on these to determine a direction relative to the apparatus of the audio source. The audio source spatial analysis results can then be passed to the spatial audio motion determiner.

The operation of determining the spatial direction from audio signals is shown in FIG. 3 in step 203.

In some embodiments the spatial audio capture apparatus 101 comprises a framer 301. The framer 301 can be configured to receive the audio signals from the microphones and divide the digital format signals into frames or groups of audio sample data. In some embodiments the framer 301 can furthermore be configured to window the data using any suitable windowing function. The framer 301 can be configured to generate frames of audio signal data for each microphone input wherein the length of each frame and a degree of overlap of each frame can be any suitable value. For example in some embodiments each audio frame is 20 milliseconds long and has an overlap of 10 milliseconds between frames. The framer 301 can be configured to output the frame audio data to a Time-to-Frequency Domain Transformer 303.

The operation of framing the audio signal data is shown in FIG. 5 by step 403.

In some embodiments the spatial audio capture apparatus 101 is configured to comprise a Time-to-Frequency Domain Transformer 303. The Time-to-Frequency Domain Transformer 303 can be configured to perform any suitable time-to-frequency domain transformation on the frame audio data. In some embodiments the Time-to-Frequency Domain Transformer can be a Discrete Fourier Transformer (DTF). However the Transformer can be any suitable Transformer such as a Discrete Cosine Transformer (DCT), a Modified Discrete Cosine Transformer (MDCT), or a quadrature mirror filter (QMF). The Time-to-Frequency Domain Transformer 303 can be configured to output a frequency domain signal for each microphone input to a sub-band filter 305.

The operation of transforming each signal from the microphones into a frequency domain, which can include framing the audio data, is shown in FIG. 5 by step 405.

In some embodiments the spatial audio capture apparatus 101 comprises a sub-band filter 305. The sub-band filter 305 can be configured to receive the frequency domain signals from the Time-to-Frequency Domain Transformer 303 for each microphone and divide each microphone audio signal frequency domain signal into a number of sub-bands.

The sub-band division can be any suitable sub-band division. For example in some embodiments the sub-band filter 305 can be configured to operate using psycho-acoustic filtering bands. The sub-band filter 305 can then be configured to output each domain range sub-band to a direction analyser 307.

The operation of dividing the frequency domain range into a number of sub-bands for each audio signal is shown in FIG. 5 by step 407.

In some embodiments the spatial audio capture apparatus 101 can comprise a direction analyser 307. The direction analyser 307 can in some embodiments be configured to select a sub-band and the associated frequency domain signals for each microphone of the sub-band.

The operation of selecting a sub-band is shown in FIG. 5 by step 409.

The direction analyser 307 can then be configured to perform directional analysis on the signals in the sub-band. The directional analyser 307 can be configured in some embodiments to perform a cross correlation between the microphone pair sub-band frequency domain signals.

In the direction analyser 307 the delay value of the cross correlation is found which maximises the cross correlation product of the frequency domain sub-band signals. This delay shown in FIG. 8 as time value b can in some embodiments be used to estimate the angle or represent the angle from the dominant audio signal source for the sub-band. This angle can be defined as a. It would be understood that whilst a pair or two microphones can provide a first angle, an improved directional estimate can be produced by using more than two microphones and preferably in some embodiments more than two microphones on two or more axes.

The operation of performing a directional analysis on the signals in the sub-band is shown in FIG. 5 by step 411.

Specifically in some embodiments this direction analysis can be defined as receiving the audio sub-band data. With respect to FIG. 6 the operation of the direction analyser according to some embodiments is shown. The direction analyser received the sub-band data;

$$X_k^b(n)=X_k(n_b+n),\ n=0,\ldots,n_{b+1}-n_b-1,\ b=0,\ldots,B-1$$

where $n_b$ is the first index of bth subband. In some embodiments for every subband the directional analysis as described herein as follows. First the direction is estimated with two channels (in the example shown in FIG. 8 the implementation shows the use of channels 2 and 3 i.e. microphones 2 and 3). The direction analyser finds delay $\tau_b$ that maximizes the correlation between the two channels for subband b. DFT domain representation of e.g. $X_k^b(n)$ can be shifted $\tau_b$ time domain samples using $$X_{k,\tau_b}^b(n) = X_k^b(n)e^{j\frac{2\pi n\tau_b}{N}}.$$

The optimal delay in some embodiments can be obtained from $$\max_{\tau_b} \operatorname{Re}\left(\sum_{n=0}^{n_{b+1}-n_b-1} \left(X_{2,\tau_b}^b(n) * X_3^b(n)\right)\right),\ \tau_b \in [-D_{t0l}, D_{t0r}]$$

where Re indicates the real part of the result and * denotes complex conjugate. $X_{2,\tau_b}^b$ and $X_3^b$ are considered vectors with length of $n_{b+1}-n_b-1$ samples. The direction analyser can in some embodiments implement a resolution of one time domain sample for the search of the delay.

Figure 6:
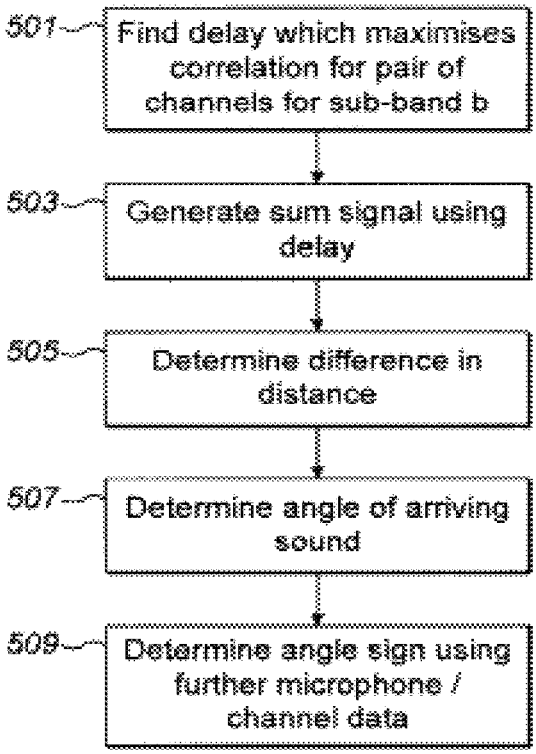
FIG. 6 shows a flow diagram of the operation of the directional analysis of the captured audio signals.

The operation of finding the delay which maximises correlation for a pair of channels is shown in FIG. 6 by step 501.

In some embodiments the direction analyser with the delay information generates a sum signal. The sum signal can be mathematically defined as.

$$X_{sum}^b = \begin{cases} (X_{2,\tau_b}^b + X_3^b)/2 & \tau_b \le 0 \\ (X_2^b + X_{3-\tau_b}^b)/2 & \tau_b > 0 \end{cases}$$

In other words the direction analyser is configured to generate a sum signal where the content of the channel in which an event occurs first is added with no modification, whereas the channel in which the event occurs later is shifted to obtain best match to the first channel.

The operation of generating the sum signal is shown in FIG. 6 by step 503.

It would be understood that the delay or shift $\tau_b$ indicates how much closer the sound source is to the microphone 2 than microphone 3 (when $\tau_b$ is positive sound source is closer to microphone 2 than microphone 3). The direction analyser can be configured to determine actual difference in distance as $$\Delta_{23} = \frac{v\tau_b}{F_s}$$

where Fs is the sampling rate of the signal and v is the speed of the signal in air (or in water if we are making underwater recordings). The operation of determining the actual distance is shown in FIG. 6 by step 505.

The angle of the arriving sound is determined by the direction analyser as, $$\alpha_b = \pm\cos^{-1}\left(\frac{\nabla_{23}^2 + 2b\Delta_{23} - d^2}{2db}\right)$$

where d is the distance between the pair of microphones and b is the estimated distance between sound sources and nearest microphone. In some embodiments the direction analyser can be configured to set the value of b to a fixed value. For example b=2 meters has been found to provide stable results. The operation of determining the angle of the arriving sound is shown in FIG. 6 by step 507. It would be understood that the determination described herein provides two alternatives for the direction of the arriving sound as the exact direction cannot be determined with only two microphones.

In some embodiments the directional analyser can be configured to use audio signals from a third channel or the third microphone to define which of the signs in the determination is correct. The distances between the third channel or microphone (microphone 1 as shown in FIG. 8) and the two estimated sound sources are:

$$\delta_b^+ \sqrt{(h+b\sin(a_b))^2+(d/2+b\cos(a_b))^2}$$

$$\delta_b^- \sqrt{(h+b\sin(a_b))^2+(d/2+b\cos(a_b))^2}$$

where h is the height of the equilateral triangle, i.e.

$$h = \frac{\sqrt{3}}{2}d.$$

The distances in the above determination can be considered to be equal to delays (in samples) of;

$$\tau_b^+ = \frac{\delta^+ - b}{v}F_s$$

$$\tau_b^- = \frac{\delta^- - b}{v}F_s$$

Out of these two delays the direction analyser in some embodiments is configured to select the one which provides better correlation with the sum signal. The correlations can for example be represented as $$c_b^+ = \operatorname{Re}\left(\sum_{n=0}^{n_{b+1}-n_b-1} \left(X_{sum,\tau_b^+}^b(n) * X_1^b(n)\right)\right)$$

$$c_b^- = \operatorname{Re}\left(\sum_{n=0}^{n_{b+1}-n_b-1} \left(X_{sum,\tau_b^-}^b(n) * X_1^b(n)\right)\right)$$

The directional analyser can then in some embodiments then determine the direction of the dominant sound source for subband b as:

$$\alpha_b = \begin{cases} \alpha_b & c_b^+ \geq c_b^- \\ -\alpha_b & c_b^+ < c_b^- \end{cases}.$$

The operation of determining the angle sign using further microphone/channel data is shown in FIG. 6 by step 509.

The operation of determining the directional analysis for the selected sub-band is shown in FIG. 5 by step 411.

Figure 7:
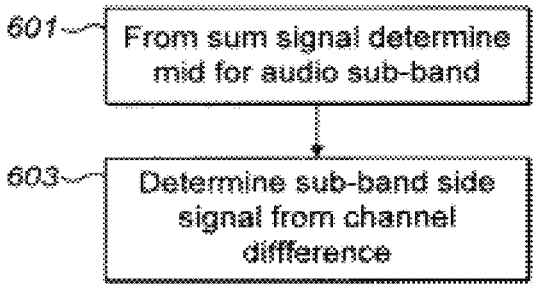
FIG. 7 shows a flow diagram of the operation of the mid/side signal generator according to some embodiments.

In some embodiments the spatial audio capture apparatus 101 further comprises a mid/side signal generator 309. The operation of the mid/side signal generator 309 according to some embodiments is shown in FIG. 7.

Following the directional analysis, the mid/side signal generator 309 can be configured to determine the mid and side signals for each sub-band. The main content in the mid signal is the dominant sound source found from the directional analysis. Similarly the side signal contains the other parts or ambient audio from the generated audio signals. In some embodiments the mid/side signal generator 309 can determine the mid M and side S signals for the sub-band according to the following equations:

$$M^b = \begin{cases} (X_{2,\tau_b}^b + X_3^b)/2 & \tau_b \leq 0 \\ (X_2^b + X_{3-\tau_b}^b)/2 & \tau_b > 0 \end{cases}$$

$$S^b = \begin{cases} (X_{2,\tau_b}^b + X_3^b)/2 & \tau_b \leq 0 \\ (X_2^b + X_{3-\tau_b}^b)/2 & \tau_b > 0 \end{cases}$$

It is noted that the mid signal M is the same signal that was already determined previously and in some embodiments the mid signal can be obtained as part of the direction analysis. The mid and side signals can be constructed in a perceptually safe manner such that the signal in which an event occurs first is not shifted in the delay alignment. The mid and side signals can be determined in such a manner in some embodiments is suitable where the microphones are relatively close to each other. Where the distance between the microphones is significant in relation to the distance to the sound source then the mid/side signal generator can be configured to perform a modified mid and side signal determination where the channel is always modified to provide a best match with the main channel.

The operation of determining the mid signal from the sum signal for the audio sub-band is shown in FIG. 7 by step 601.

The operation of determining the sub-band side signal from the channel difference is shown in FIG. 7 by step 603.

The operation of determining the side/mid signals is shown in FIG. 5 by step 413.

The operation of determining whether or not all of the sub-bands have been processed is shown in FIG. 5 by step 415.

Where all of the sub-bands have been processed, the end operation is shown in FIG. 5 by step 417.

Where not all of the sub-bands have been processed, the operation can pass to the operation of selecting the next sub-band shown in FIG. 5 by step 409.

In some embodiments the spatial audio processor includes a spatial audio motion determiner 103. The spatial audio motion determiner is in some embodiments configured to receive a user interface input and from the user interface input determine a 'virtual' or desired audio listener position motion or positional difference value which can be passed together with the spatial audio signal parameters to a spatial motion audio processor 105.

The operation of determining when a desired motion input has been received is shown in FIG. 3 in step 205.

Figure 9:
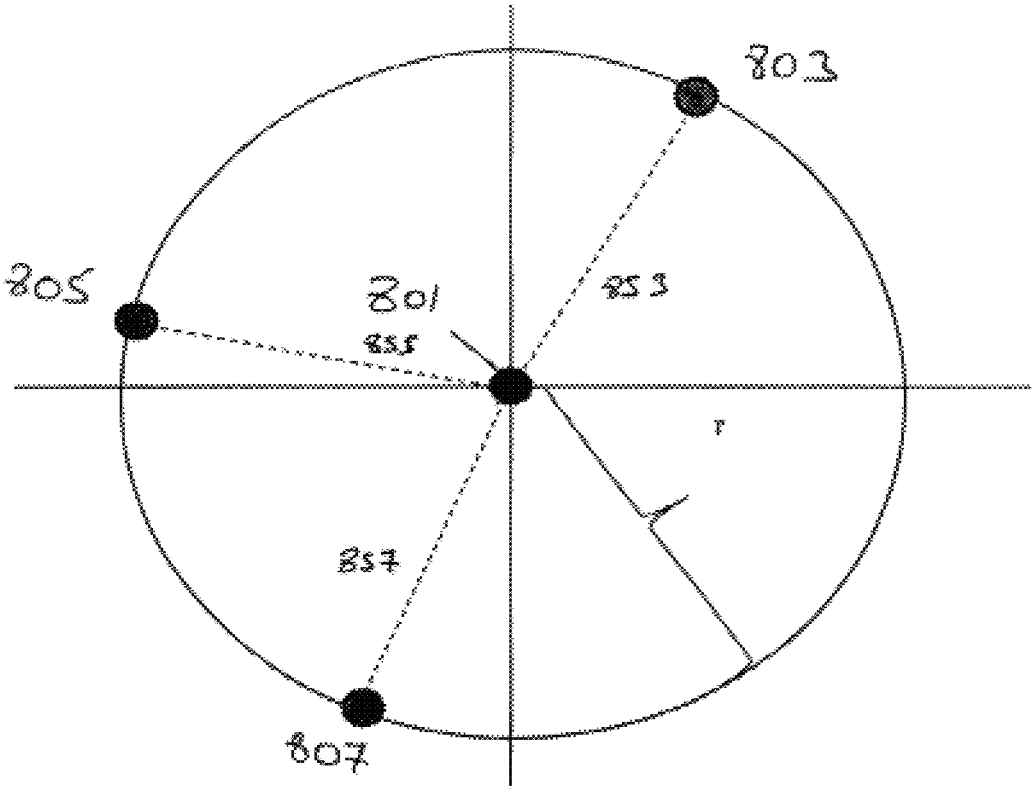
FIG. 9 shows an example capture apparatus and signal source configuration according to some embodiments.
Figure 10:
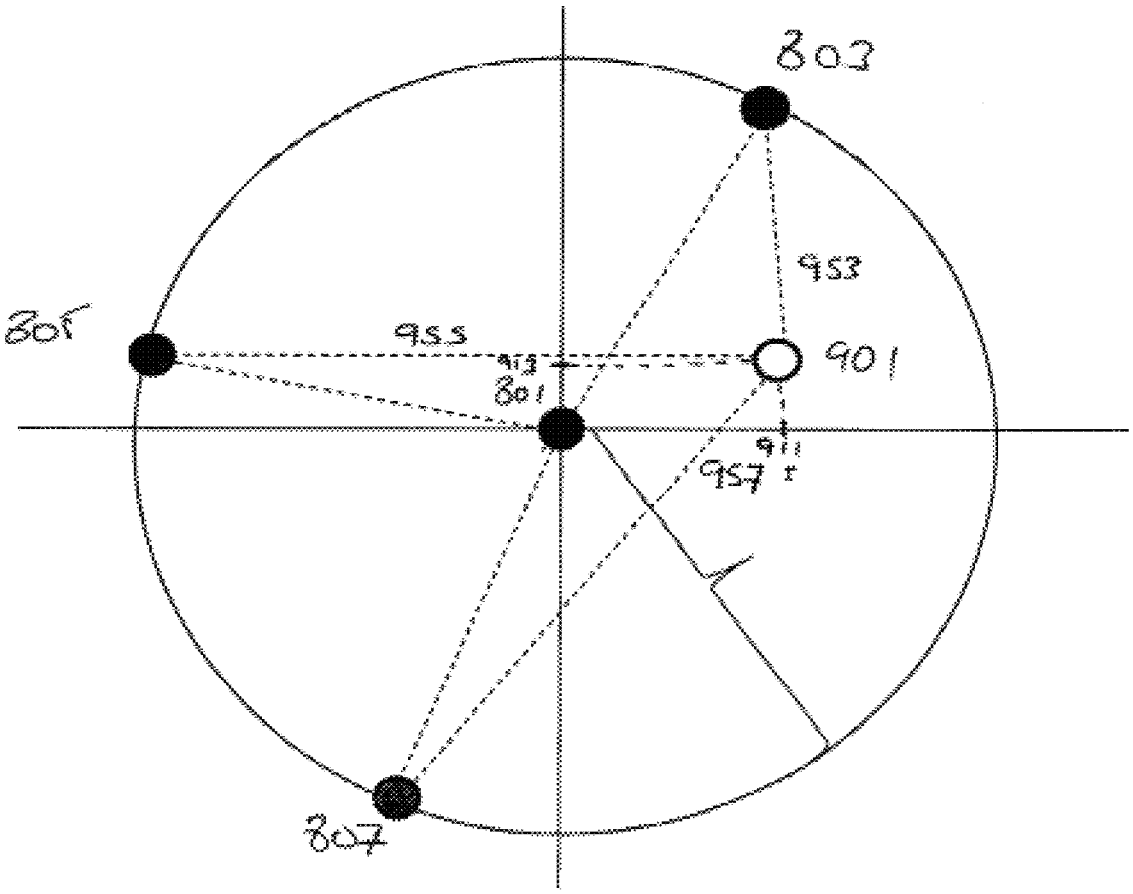
FIG. 10 shows an example virtual motion of capture apparatus operation according to some embodiments.

An example virtual motion is shown in FIGS. 9 and 10. In FIG. 9 a sound scene is shown wherein the location of the sound sources 803, 805 and 807 from the recording or capture apparatus 801 is such that the distances are relatively far from the recording apparatus to be approximated to be having a far field radius r and a directional component from the capture apparatus 801 such that the first sound source 803 has a first direction 853, a second sound source 805 has a second directional sound component, 855 and a third sound source 807 has a third directional component 857.

A user interface input such as moving an icon on a representation on a screen can perform a virtual motion which then defines a desired or virtual position for the recording apparatus. The virtual position in some embodiments has to be inside the circle defined by the radius r, in other words the desired or virtual position cannot be behind any estimated sound source position in order to maintain accuracy. The new virtual position can thus be generated by the spatial motion audio processor simply by modifying the angles of the sound sources. Such that where the first, second and third directional components 853, 855 and 857 as shown in FIG. 9 are modified to be the new directional components 953, 955 and 957 due to a displacement in the "X" direction 911 and the "Y" direction 913.

In some embodiments the apparatus comprises a spatial motion audio processor 105.

In some embodiments the spatial motion audio processor 105 can be configured to receive the detected motion or positioned change from the user interface input and the spatial audio signal data to produce new audio outputs. The operation of audio signal processing from the motion determination is shown in FIG. 3 by step 207.

Figure 11:
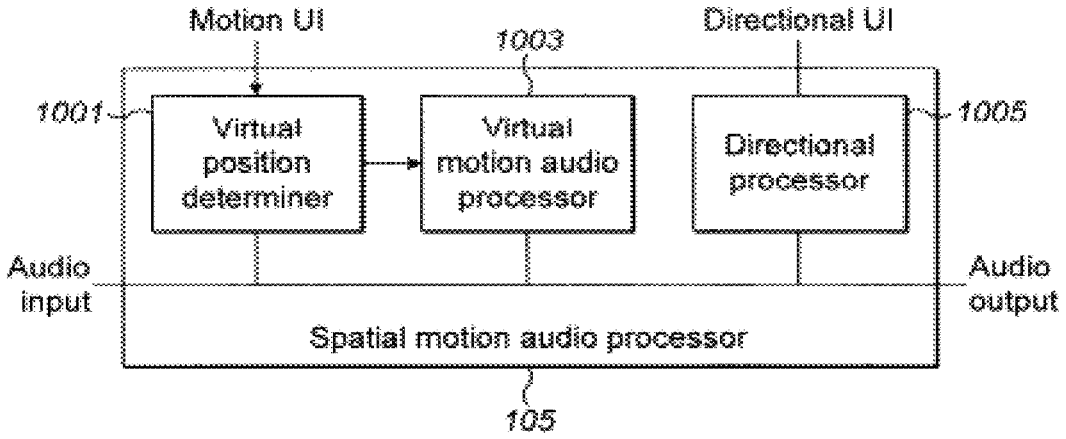
FIG. 11 shows the spatial motion audio processor in further detail.

With respect to FIG. 11 a spatial motion audio processor 105 according to some embodiments is shown. Furthermore with respect to FIGS. 12 and 13 the operation of the spatial motion audio processor according to some embodiments is described in further detail.

In some embodiments the spatial motion audio processor 105 can comprise a virtual position determiner 1001. The virtual position determiner 1001 can be configured to receive the input from the spatial audio motion determiner with regards to a motion input.

Figure 12:
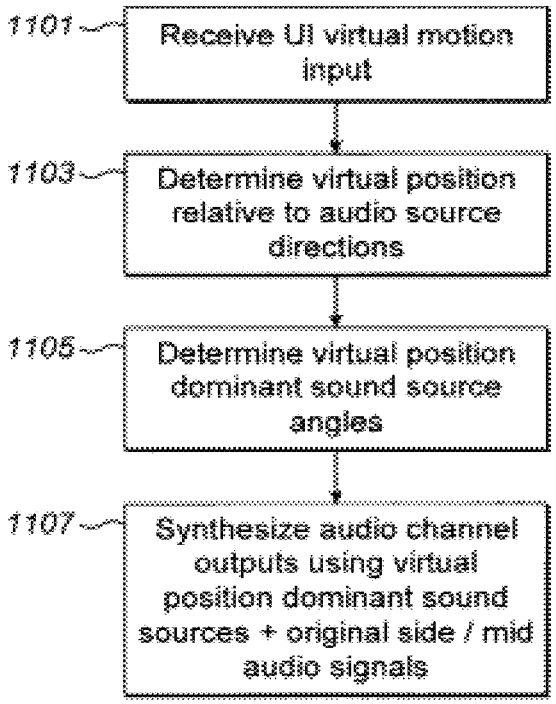
FIG. 12 shows a flow diagram of the operation of the virtual position determiner and virtual motion audio processor shown in FIG. 11 according to some embodiments.

The operation of receiving the detected motion input is shown in FIG. 12 by step 1101. The virtual position determiner can in some embodiments determine the position of the new virtual apparatus position in relation to the determined audio sources. In some embodiments this can be carried out by the following operations:

The new virtual position for the apparatus can be generated in some embodiments by modifying the angles of the sound sources. For example using FIG. 9 the first direction 853, second direction 855, and third direction 857 can be $a_1$ represented by, $a_2$ and $a_3$ as the original angles of the three sound sources. In some embodiments where the source distance is distance r, these angles correspond to defining source coordinates $[x_1y_1]$, $[x_2y_2]$ and $[x_3y_3]$ where the values are obtained as $$x_b = r\sin(a_b)$$

$$y_b = r\cos(a_b)$$

The virtual position determiner can determine that based on an input that the desired position of the apparatus is $[x_v y_v]$. The operation of determining the virtual position relative to the audio source directions is shown in FIG. 12 by step 1103.

In some embodiments the spatial motion audio processor 105 comprises a virtual motion audio processor 1003. The virtual motion audio processor 1003 in some embodiments can calculate the new, updated sound source angles for the new position are obtained as $$\hat{a}_b = a \tan 2(x_b - x_v, y_b - y_v)$$

where atan 2 is four quadrant inverse tangent, and it is defined as follows:

$$\text{atan2}(a, b) = \begin{cases} \arctan\left(\frac{a}{b}\right) & b > 0 \\ \pi + \arctan\left(\frac{a}{b}\right) & a \geq 0, b < 0 \\ -\pi + \arctan\left(\frac{a}{b}\right) & a < 0, b < 0 \\ \frac{\pi}{2} & a > 0, b = 0 \\ -\frac{\pi}{2} & a < 0, b = 0 \\ NaN & a = 0, b = 0 \end{cases}$$

The operation of determining virtual position dominant sound source angles is shown in FIG. 12 by step 1105.

It would be understood that the situation with a=b=0 is not defined, however that is not a problem as in that case the new position is the same as the original position and there is no change to the sound source directions.

It would be understood that the audio source angles have been updated and a suitable value for the radius r is in some embodiments 2 meters. Although in reality a sound source could be closer than 2 meters, the sound source placement at 2 m for a hand portable device have been shown to be realistic.

The virtual motion audio processor 1003 can further use the new virtual position dominant sound source angles and from these determine or synthesise audio channel outputs using the virtual position dominant sound sources directions, and the original side and mid audio signals.

This rendering of audio signals in some embodiments can be performed according to any suitable synthesis.

The operation of synthesising the audio channel outputs using virtual position dominant sound source estimators and original side and mid audio signal values is shown in FIG. 12 by step 1107.

In some embodiments the spatial motion audio processor 105 can comprise a directional processor 1005. The directional processor 1005 can be configured to receive a directional user interface input in the form of a 'directional' input, convert this into a suitable spatial profile filter for the audio signal and apply this to the audio signal.

Figure 14:
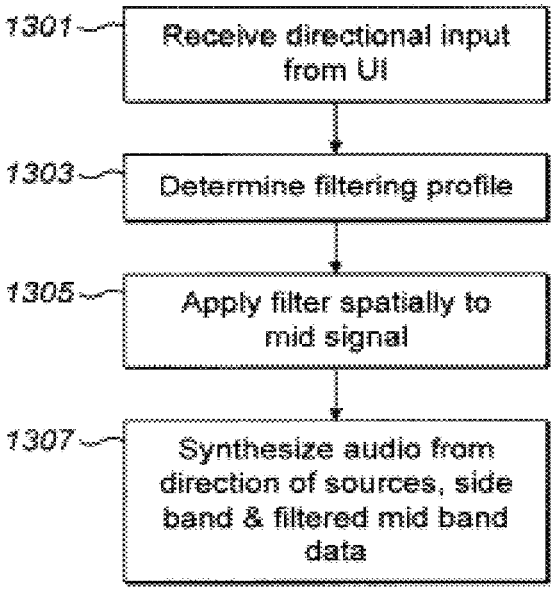
FIG. 14 shows a flow diagram of the operation of the directional processor according to some embodiments.

With respect to FIG. 14 the example of operations of a directional processor according to some embodiments is shown.

Figure 15:
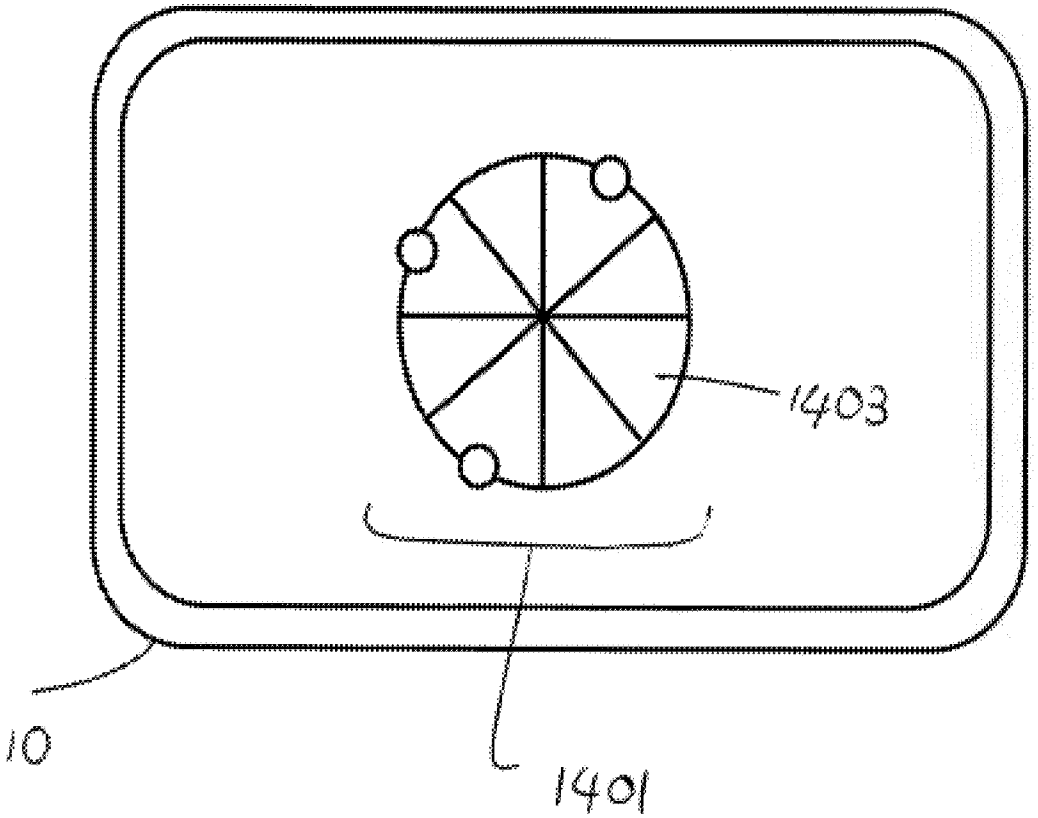
FIG. 15 shows an example of apparatus suitable for implementing embodiments with a touch screen display.

With respect to FIG. 15 an example directional input is shown wherein the apparatus 10 displays a visualisation of the audio scene 1401 with the recording device or user in the middle of the circle of the visualisation 1401. The user can then select a selector 1403 from the visualisation of the audio scene in order to select a direction. In some embodiments the direction and the profile can be selected.

The operation of receiving the directional input from the user interface is shown in FIG. 14 by step 1301.

The directional processor 1005 can furthermore then determine a filtering profile. The filtering profile can be generated using any suitable manner using suitable transition regions.

Figure 13A:
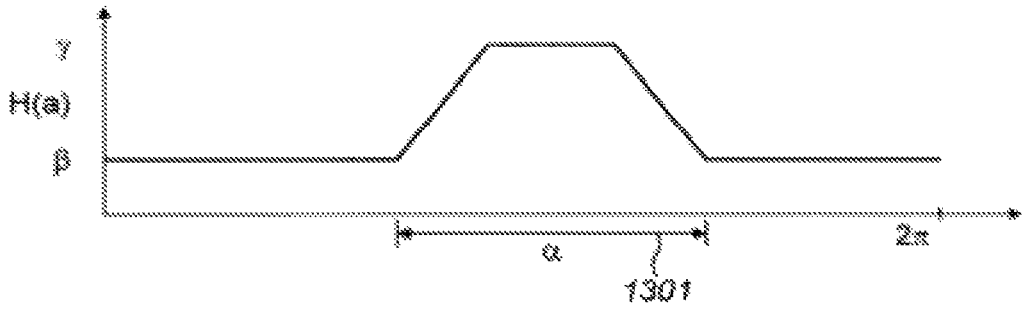
FIGS. 13*a* to 13*c* show example spatial filtering profiles according to some embodiments.
Figure 13B:
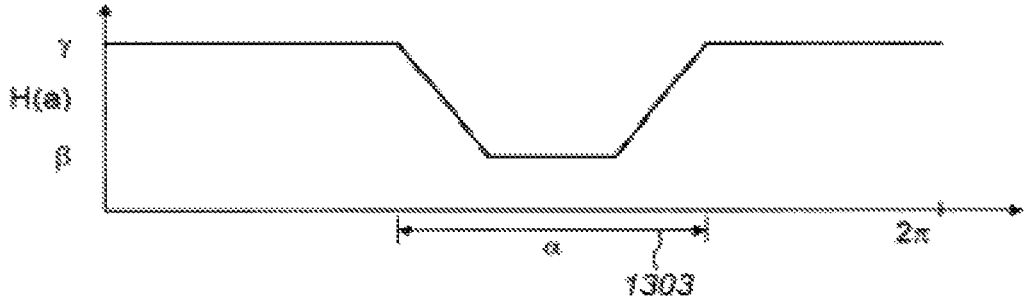
Figure 13C:
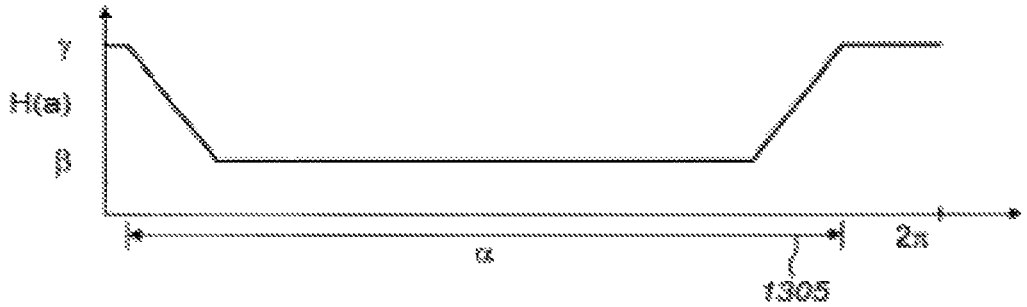

Example profiles are shown according to FIGS. 13*a* to 13*c*. In 13*a*, amplification directional selection is shown, in FIG. 13*b* a directional muting is shown and in FIG. 13*c*, amplification directional selection across the 2 π boundary is shown.

It would be understood that the profile and direction selections run by manual such as purely from the user interface semi-automatic where options are provided for selection and automatic where the direction and profile is selected due to detected or determined parameters.

The operation of determining the filtering profile is shown in FIG. 14 by step 1303.

The directional processor 1005 can then apply the spatial filtering to the mid signal. In other words where the mid signal is within the determined area, the mid signal can be amplified or damped.

The operation of applying the filter spatially to the mid signal is shown in FIG. 14 by step 1305.

Furthermore the directional processor can then synthesise the audio from the direction of sources side band and filtered mid band data. The operation of synthesising the audio from the direction of sources side band and mid band data is shown in FIG. 14 by step 1307.

The amplitude modification can be performed according to a modification function H for the mid band signal according to $$\overline{M}^b = H(a_b) M^b$$

It would be understood that dependent on the user interface directional area around the selected direction or the angle is amplified or attenuated. In the example figures the filter profiles selected use linear interpolation in any transition periods between normal and scaled levels, however it would be understood that any suitable interpolation techniques can be utilized.

Furthermore in the example profiles Factors β and γ are used in some embodiments in scaling to confirm that the overall amplitude of the signal remains at reasonable level. In case of damping γ can be set to 1 and β to zero. In case of amplifying one direction the selected value of γ cannot be set too large or a maximum allowed amplitude for the signal can in some examples be exceeded. Therefore in some embodiments the parameter β to dampen other parts of the signal (i.e. β is smaller than 1) which in turn enables that Y does not have to be too large.

Figure 16:
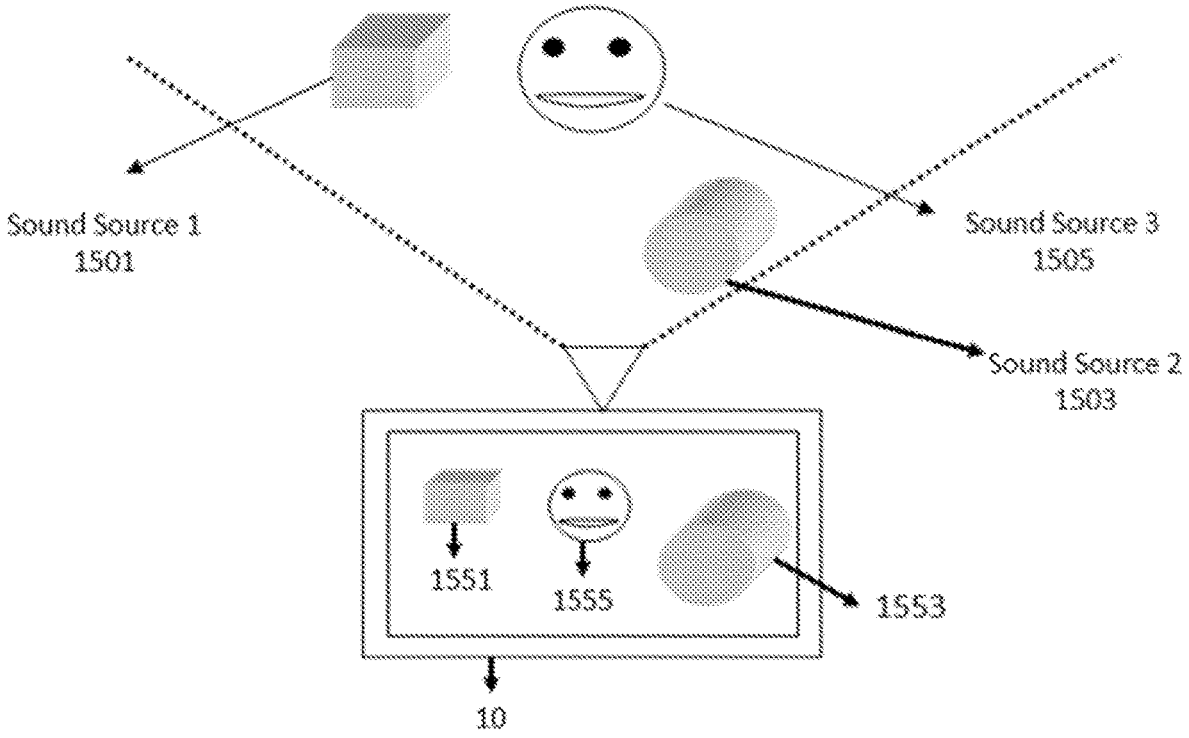
FIG. 16 shows a user interface.

With respect to FIG. 16 a suitable user interface which could provide the inputs for modifying the spatial audio field is shown. The apparatus 10 displays visual representations of the sound sources on the display. Thus the sound source 1 1501 is visually represented by the icon 1551, the sound source 2 1503 is represented by the icon 1553 and the sound source 3 1505 is represented by the icon 1555. These icons are displayed or represented visually on the display approximately within the display at the angle the user would experience then visually if using the apparatus 10 camera.

In some embodiments the user interface can be as shown in FIG. 15 where the user is situated in the middle of a circle and there are sectors (in this example 8) around the user. Using a touch user interface a user can amplify or dampen any of the 8 sectors. For example a selection can be performed in some embodiments where one click equals to amplification and two clicks indicates an attenuation. As shown in FIG. 15 the user representation may visualise the directions of main sound sources with icons such as the grey circles shown in FIG. 15. The visualisation of the sound or audio sources enables the user to easily see the directions of the current sound sources and modify their amplitudes or the direction to them.

In some embodiments the direction of the main sound sources visualised can be based on statistical analysis in other words the sound source is only displayed where it persists over several frames.

As shown in FIG. 16 the camera and the touch screen of the mobile device can be combined to provide an intuitive way to modify the amplitude of different sound sources. The example shown in FIG. 16 shows three dominant sound sources, the third sound source 1505 being a person talking and the other two sound sources being considered as 'noise' sound sources.

In some embodiments the user interface can be an interaction with the touch screen to modify the amplitude of the sound sources. For example in some embodiments the user can tap an object on the touch screen to indicate the important sound source (for example sound source 3 1505 as shown by icon 1555). For the location of this tap the user interface can determine the angle of the important sound source which is used at the signal processing level to amplify the sound coming from the corresponding direction.

In some embodiments for example during video recording a camera focussing on a certain object either through auto focus or manual interaction can enable an input where the user interface can determine the angle of the focussed object and dampen the sounds coming from other directions to improve the audibility of the important object.

In some embodiments the video recording automatically detects faces and determines if a person exists in the video and the direction of the person to determine whether or not the person is a sound source and amplify the sounds coming from the person.

The synthesis of the multi-channel or binaural signal using the modified mid-signal, side-signal and the angle to the mid-signal can be formed in any suitable manner. In some embodiments an additional direction figure is created. The directional figure is similar to the directional source that is limited to a sub-set of all directions. In other words the directional component is quantised. If some directions are to be attenuated more than others then the modified directional component is not searched from these directions.

For example all the directions where $\beta \leq \varepsilon \cdot \mathrm{ave}(H(a))$ would be excluded from the search for $\hat{a}_b$, ε may be for example $$\frac{1}{2}.$$

Alternatively, it some airections were to be amplified significantly more than other directions, the search for could be limited to those directions. Thus for example the search for r could be limited to directions where $\beta \geq E \cdot \mathrm{ave}(H(a))$, where E may be in some embodiments 2.

The value or variable $a_b$ can in some embodiments be used to obtain information about the directions of main sound sources and displaying that information for the user. The variable $\hat{a}_b$ can similarly in some embodiments be used for calculating the mid $M^b$ and side $S^b$ signals for the sub-bands.

In the description herein the components can be considered to be implementable in some embodiments at least partially as code or routines operating within at least one processor and stored in at least one memory.

It shall be appreciated that the term user equipment is intended to cover any suitable type of wireless user equipment, such as mobile telephones, portable data processing devices or portable web browsers.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer code for one or more programs, the at least one memory and the computer code configured to with the at least one processor cause the apparatus at least to:

receive, from at least one sensor, a position of the apparatus;

receive at least one audio signal of at least one audio source, wherein the at least one audio signal is captured by at least one microphone of the apparatus;

perform directional analysis to determine a direction of the at least one audio source;

receive an indication of a change of the position of the apparatus;

determine a change in the direction of the at least one audio source as a result of the change of the position of the apparatus;

provide a modified version of the at least one audio source according to the change in the direction of the at least one audio source as a result of the change of the position of the apparatus;

process the at least one audio signal based on the modified version of the at least one audio source; and reproduce the processed at least one audio signal in playback.

2. The apparatus as claimed in claim 1, wherein the at least one sensor is at least one of: a satellite positioning sensor; electronic compass sensor; accelerometer; or gyroscope.

3. The apparatus as claimed in claim 1, wherein the at least one memory and the computer code are further configured to with the at least one processor cause the apparatus at least to:

identify, based on an audio data, if focus is on another at least one audio source; and amplify the another at least one audio source having the focus and dampen the at least one audio source.

4. The apparatus as claimed in claim 1, wherein the at least one memory and the computer code are further configured to with the at least one processor cause the apparatus at least to:

in response to receiving the indication of the change of the position of the apparatus, selectively modify the direction of sound movement associated with the at least one audio source thereby distinguishing audible intelligibility for the at least one audio source from one or more other audio sources.

5. The apparatus as claimed in claim 1, wherein determining the change in the direction of sound movement associated with the at least one audio source as a result of the change of the position of the apparatus further comprises providing directional analysis using the at least one audio signal, wherein providing directional analysis comprises:

dividing the at least one audio signal into frequency bands; and performing the directional analysis based on the frequency bands.

6. The apparatus as claimed in claim 1, wherein processing the at least one audio signal further comprises generating at least one further audio signal.

7. The apparatus as claimed in claim 6, wherein generating the at least one further audio signal comprises one of:

a multichannel audio signal;

the at least one audio source and the audio data comprising the direction of sound movement associated with the at least one audio source; or an ambient audio signal associated with the at least one audio source.

8. The apparatus as claimed in claim 6, wherein generating the at least one further audio signal further comprises generating a spatial filter; and applying the spatial filter to the at least one audio signal to modify a spatial audio field comprising the at least one audio source by the at least one audio signal.

9. The apparatus as claimed in claim 8, wherein generating the spatial filter comprises at least one of:

determining the spatial filter is dependent on a user input;

determining the spatial filter is dependent on the position of the apparatus;

determining the spatial filter is dependent on a position of the at least one audio source;

or determining the spatial filter is dependent on a recognized position of the at least one audio source.

10. The apparatus as claimed in claim 1, wherein providing the modified version of the at least one audio source comprises changing a sound parameter of the at least one audio source.

11. A method comprising:

receiving, from at least one sensor, a position of an apparatus;

receiving at least one audio signal of at least one audio source, wherein the at least one audio signal is captured by at least one microphone of the apparatus;

performing directional analysis to determine a direction of the at least one audio source;

receiving an indication of a change of the position of the apparatus;

determining a change in the direction of the at least one audio source as a result of the change of the position of the apparatus;

providing a modified version of the at least one audio source according to the change in the direction of the at least one audio source as a result of the change of the position of the apparatus;

processing the at least one audio signal based on the modified version of the at least one audio source; and reproducing the processed at least one audio signal in playback.

12. The method as claimed in claim 11, wherein the at least one sensor is at least one of: a satellite positioning sensor; electronic compass sensor; accelerometer; or gyroscope.

13. The method as claimed in claim 11 further comprising:

identifying, based on an audio data, if focus is on another at least one audio source; and amplifying the another at least one audio source having the focus and dampen the at least one audio source.

14. The method as claimed in claim 11 further comprising:

in response to receiving the indication of the change of the position of the apparatus, selectively modify the direction of sound movement associated with the at least one audio source thereby distinguishing audible intelligibility for the at least one audio source from one or more other audio sources.

15. The method as claimed in claim 11, wherein determining the direction of sound movement associated with each of the at least two audio sources based on the at least one audio signal further comprises providing a directional analysis using the at least one audio signal, wherein providing the directional analysis comprises:

dividing the at least one audio signal into frequency bands; and performing the directional analysis based on the frequency bands.

16. The method as claimed in claim 11, wherein processing the at least one audio signal further comprises generating at least one further audio signal.

17. The method as claimed in claim 16, wherein generating the at least one further audio signal comprises one of:

a multichannel audio signal;

the at least one audio source and the audio data comprising the direction of sound movement associated with the at least one audio source; or an ambient audio signal associated with the at least one audio source.

18. The method as claimed in claim 16, wherein generating the at least one further audio signal further comprises generating a spatial filter; and applying the spatial filter to the at least one audio signal to modify a spatial audio field comprising the at least one audio source by the at least one audio signal.

19. The method as claimed in claim 18, wherein generating the spatial filter comprises at least one of:

determining the spatial filter is dependent on a user input;

determining the spatial filter is dependent on the position of the apparatus;

determining the spatial filter is dependent on a position of the at least one audio source;

or determining the spatial filter is dependent on a recognized position of the at least one audio source.

20. A computer program product comprising at least one non-transitory computer-readable storage medium having computer-executable program code portions stored therein, the computer-executable program code portions comprising program code instructions for:

receiving, from at least one sensor, a position of an apparatus;

receiving at least one audio signal of at least one audio source, wherein the at least one audio signal is captured by at least one microphone of the apparatus;

performing directional analysis to determine a direction of the at least one audio source;

receiving an indication of a change of the position of the apparatus;

determining a change in the direction of the at least one audio source as a result of the change of the position of the apparatus;

providing a modified version of the at least one audio source according to the change in the direction of the at least one audio source as a result of the change of the position of the apparatus;

processing the at least one audio signal based on the modified version of the at least one audio source; and reproducing the processed at least one audio signal in playback.

* * * * *